US007021029B2

(12) United States Patent
Hannen et al.

(10) Patent No.: US 7,021,029 B2
(45) Date of Patent: Apr. 4, 2006

(54) METHOD OF WRAPPING AN OBJECT STACK WITH A STRETCHABLE FLAT TUBE

(75) Inventors: Reiner Hannen, Kalkar-Wissel (DE); Norbert Vermeulen, Kleve-Warbeyen (DE)

(73) Assignee: MSK-Verpackungs-Systeme Gesellschaft MIT Berschrankter Haftung, Kleve (DE)

( * ) Notice: Subject to any disclaimer, the term of this patent is extended or adjusted under 35 U.S.C. 154(b) by 0 days.

(21) Appl. No.: 10/470,186

(22) PCT Filed: Jan. 23, 2002

(86) PCT No.: PCT/EP02/00632

§ 371 (c)(1),
(2), (4) Date: Jul. 24, 2003

(87) PCT Pub. No.: WO02/058996

PCT Pub. Date: Aug. 1, 2002

(65) Prior Publication Data

US 2004/0112016 A1 Jun. 17, 2004

(30) Foreign Application Priority Data

Jan. 25, 2001 (DE) ..... 101 03 261

(51) Int. Cl.
*B65B 43/26* (2006.01)

(52) U.S. Cl. ..... 53/459; 53/397; 53/399; 53/441; 53/457; 53/469

(58) Field of Classification Search ..... 53/451, 53/457, 459, 469, 551, 555, 567, 441, 397, 53/585, 574, 575, 576
See application file for complete search history.

(56) References Cited

U.S. PATENT DOCUMENTS

| | | | | | |
|---|---|---|---|---|---|
| 3,852,937 | A | * | 12/1974 | Bitsura et al. | 53/442 |
| 4,050,219 | A | * | 9/1977 | Higgins | 53/567 |
| 4,063,401 | A | * | 12/1977 | Higgins | 53/567 |
| 4,064,678 | A | * | 12/1977 | Grocke | 53/567 |
| 4,082,877 | A | * | 4/1978 | Shadle | 428/220 |
| 4,116,116 | A | * | 9/1978 | Barnett | 493/199 |
| 4,724,658 | A | * | 2/1988 | Birkenfeld et al. | 53/557 |
| 5,168,989 | A | * | 12/1992 | Benno | 206/143 |
| 6,032,439 | A | * | 3/2000 | Birkenfeld et al. | 53/441 |
| 6,298,636 | B1 | * | 10/2001 | Lachenmeier et al. | 53/442 |
| 6,381,929 | B1 | * | 5/2002 | Chen | 53/567 |
| 6,470,654 | B1 | * | 10/2002 | Lachenmeier et al. | 53/567 |
| 6,668,519 | B1 | * | 12/2003 | Richey | 53/139.7 |

FOREIGN PATENT DOCUMENTS

GB 1264196 * 2/1972

* cited by examiner

*Primary Examiner*—Stephen F. Gerrity
*Assistant Examiner*—Hemant M. Desai
(74) *Attorney, Agent, or Firm*—Herbert Dubno; Andrew Wilford

(57) ABSTRACT

A stack of object is wrapped by first transversely outwardly stretching a tube having open ends and then pulling the transversely outwardly stretched tube over the stack to a position with the tube extending generally a full length of the stack and one open end of the tube projecting past an end of the stack. Then the tube is released such that it retracts into engagement with sides of the stack and the one open tube end bears on the end of the stack at least adjacent edges of the end of the stack.

7 Claims, 4 Drawing Sheets

METHOD OF WRAPPING AN OBJECT STACK WITH A STRETCHABLE FLAT TUBE

CROSS REFERENCE TO RELATED APPLICATIONS

This application is the US national phase of PCT application PCT/EP02/00632 filed 23 Jan. 2002, published 1 Aug. 2002 as WO 02/058996, and claiming the priority of German application 101 03 261.7 filed 25 Jan. 2001.

FIELD OF THE INVENTION

The invention relates to a method of pulling a flat tube of a stretchable foil down over a stack of objects, for example on a pallet wherein the tube is stretched outward and then while still stretched is pulled over the object stack.

BACKGROUND OF THE INVENTION

With the known method a stretchable foil that is welded completely together at one end is gathered in accordion-like folds and set on rod-shaped holder elements such as gathering fingers of a tensioning frame. Then the holder elements are moved apart so that the stretchable foil is prestretched transversely. In this condition the stretching frame is moved downward along the object stack and if necessary over any pallet carrying the stack and the gathered foil is fitted against the outside of the stack and if necessary on the pallet carrying the stack. The gathering fingers can also be formed as gathering wedges, each gathering wedge being comprised of a horizontally oriented and angled tube section. The gathering wedges are oriented on the corners of the stack and are movable along lines extending through the middle of the stack to the respective corners.

A disadvantage is that the weld seam at the welded-together end that comes to rest on the top of the stack forms two large triangular upwardly projecting points. These points reach into the corners of the stack. This means on the one hand that quite a bit of foil is used. In addition these points must in a further step either be adhered to the sides or top of the stack so that the wrapped stack has a neat appearance and the points do not get in the way during transport. Adhering the points reduces the amount of printable space on the package. In addition water can get between the adhered points and be held there, something that is not wanted.

OBJECT OF THE INVENTION

It is an object of the invention to improve on the above-described method such that after drawing the tube section into place the extra foil is minimized in the region of the top and/or bottom of the stack or of the pallet carrying the stack.

SUMMARY OF THE INVENTION

This object is achieved in that the tube is upwardly and downwardly at least partially open and is stretched so much that when pulled into position an upper and/or lower end of the tube bears at least in the region of edges on the top and/or bottom of the stack or of the bottom of a pallet carrying the stack. The considerable stretching ensures that the tube lies not only on the four vertical sides of the stack, but also on the top and/or bottom of the stack or on the bottom of a pallet carrying the stack in the regions of the edges and thus serves as a support. In this manner the large triangular and laterally projecting points produced by the standard method are reduced to at most slight overages of foil at the ends of a weld seam on the top and/or bottom of the stack.

In addition as a result of the support action at the top and/or bottom end, there is considerable vertical tension that is excellent at stabilizing the object stack over which the tube is drawn. At the same time the tube, with the right tube material, disposes of considerable ability to contract when for example during transport of particle-filled stacks the sacks compact and compress together, in which case the tube can correspondingly contract to the new dimensions.

In order to pull down the tube, standard stretching machines can be used that are partially or fully automatic. In a partially automatic system the gathering and prestretching or stretching are automated. The foil is however fitted manually. With partially automatic systems premade tubes or rolls of them separated by perforations are used or manual weld beams are employed. The fully automatic machines use a continuous flat tube. They detect the height of the object to be wrapped and cut off the corresponding length. It is clear that then the tube does not have to reach underneath the pallet, but can instead only engage down past the top boards of the pallet.

To this end the upper and/or lower end of the tube lies flatly on the top and/or bottom of the stack or on the bottom of a pallet carrying the stack. As a result of the considerable prestretching the tube lies flatly on the stack or the bottom of the pallet carrying the stack so that any extra foil is not present on the top or bottom as in the prior-art system.

According to a preferred embodiment of the method the tube in condition for application to the stack is stretched by about 50% to 80%, preferably 70%, from its unstretched condition.

At least the end not drawn over the stack is welded together at least partially to form a hood-like shape so that the tube cannot be pulled completely over the stack and when complete the top or bottom is covered by the foil.

Preferably the tube is welded together generally perpendicular to a longitudinal direction of the tube. When the tube is pulled down in stretched condition the partial seams catch on the top of the stack.

In another embodiment at least the two corner regions of the end of the tube not drawn over the stack are welded together, in particular at an angle, while still flat to form weld seams. The two angled weld seams of the end not drawn down over the object stack ensure that the tube when pulled down does not move too far down over the object stack. At the same time the angled seams reduce the amount of foil in the region of the top and/or bottom of the stack or the bottom of a pallet carrying the stack so that the fit of the tube on the top and/or bottom is improved.

Here the weld seams extend in corner regions of the tube in a flat condition of the tube at an angle of about 45° to a longitudinal direction of the tube.

When carrying out the method of the invention the welded-together corner regions are positioned when the tube is mounted on the stack in the region of diagonally opposite corners of the stack. When pulling the tube down over a rectangular stack the weld seams thus run along a diagonal of the top and/or bottom of the stack.

When the tube has weld seams at both ends, in order to pull the tube over the stack the partially welded corners of the flattened tube are stretched more than the remainder of the tube is stretched. This is necessary to be able to draw the tube over the object stack. The prestretching of the tube at the leading end of the tube is up to 40% more than the rest of the tube.

In order to carry out the invention preferably for example a three-layer foil laminate is used as flat tube. Such foil laminates have considerable elasticity which is necessary for use, in particular with respect to the vertical tension to stabilize the object stack. In addition contraction by subsequent shrinkage of the stack, e.g. during transport, is possible.

Thus the two outer layers of the foil laminate are a copolymer and the inner layer is an elastomer. The elastomer layer ensures on the one hand strength and on the other hand the stretchability of the tube.

BRIEF DESCRIPTION OF THE DRAWING

In the following an embodiment of the invention is described with reference to the drawing. Therein.

SPECIFIC DESCRIPTION

Figure 1:
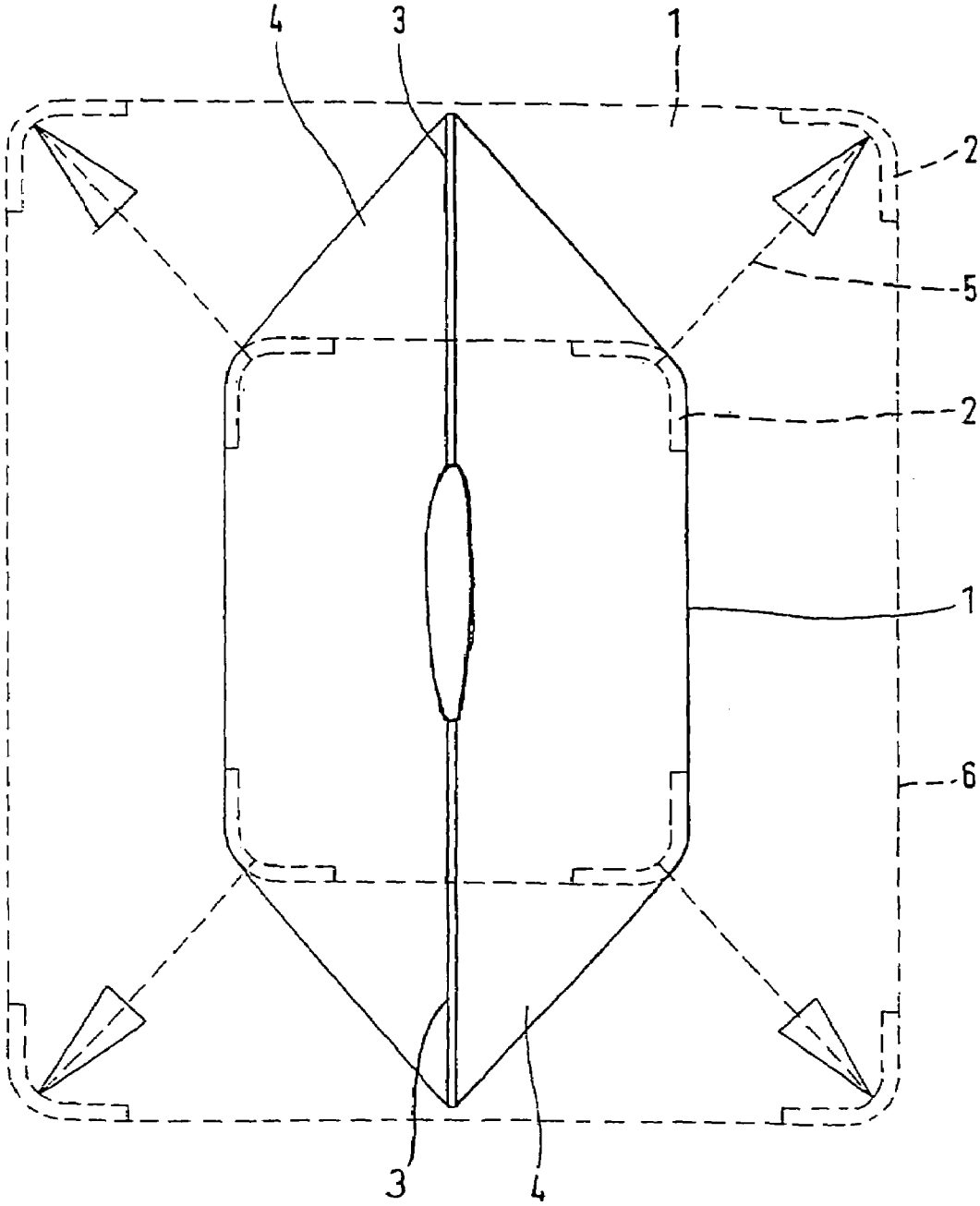
FIG. 1 is a top view of a tube mounted on gathering fingers in unstretched and stretched condition for pulling of the tube section over an object stack.

In all the figures the same or similar parts have the same reference numerals.

FIG. 1 shows a tube 1 that is stretched over four gathering fingers 2 arranged at corners of an unillustrated object stack. In the illustrated embodiment the gathering fingers 2 are formed as gathering wedges, each wedge being formed by a horizontal angled tube section.

The tube 1 has at one of its ends two opposite weld seams 3. Between the two edge weld seams 3 the tube 1 is open. Solid lines show the tube section in unstretched condition. The two narrow sides thus form large triangular foil regions 4 extending away from the gathering fingers 2.

In order to prestretch, the fingers 2 are moved in the direction of dashed-line arrows 5 into the dashed-line position 6. The regions 4 disappear altogether.

Subsequently the tube 1 is pulled over the unillustrated object stack. The gathering fingers 2 are moved along the object stack at a close spacing to it so that the gathered tube 1 is pulled off the gathering fingers 2. As a result of the considerable prestretching and the high elasticity, the tube 1 not only snugly engages the four vertical sides of the stack. It also engages against the horizontal edge regions of the top and/or bottom of the stack, or the bottom of a pallet carrying the stack at least near the edges and there lies flat.

Figure 2:
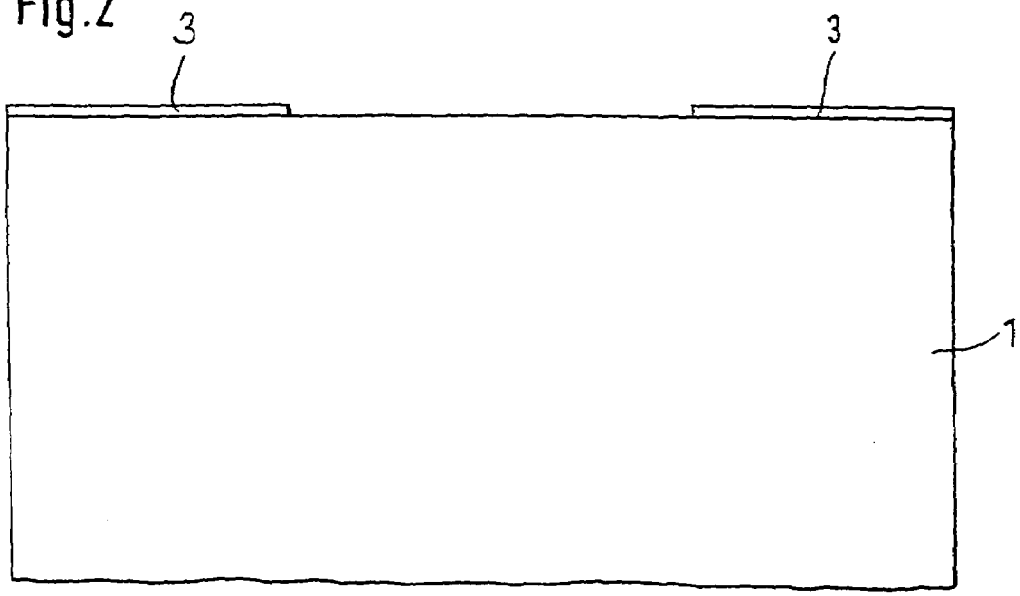
FIGS. 2–5 are different embodiments of the tube.

FIG. 2 shows the tube 1 with its weld seams 2 running orthogonal to the tube 1.

Figure 3:
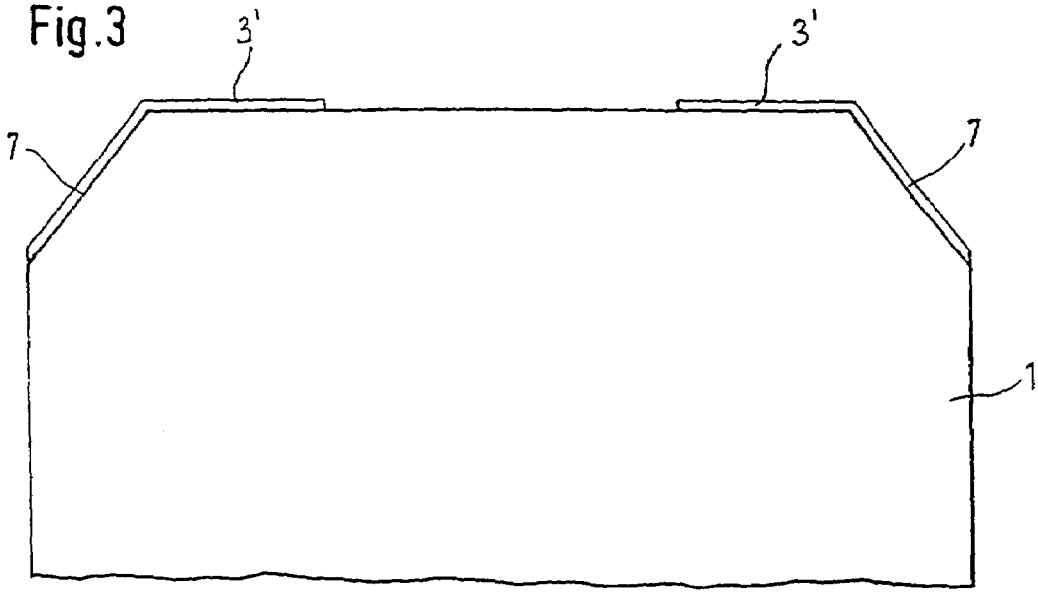

The tube in FIG. 3 is welded at a bevel in its corner regions so that the angled weld seams 7 extend to the end of the tube 1. In addition the region between the two angles seams 7 is partially welded together at further weld seams 3'.

Figure 4:
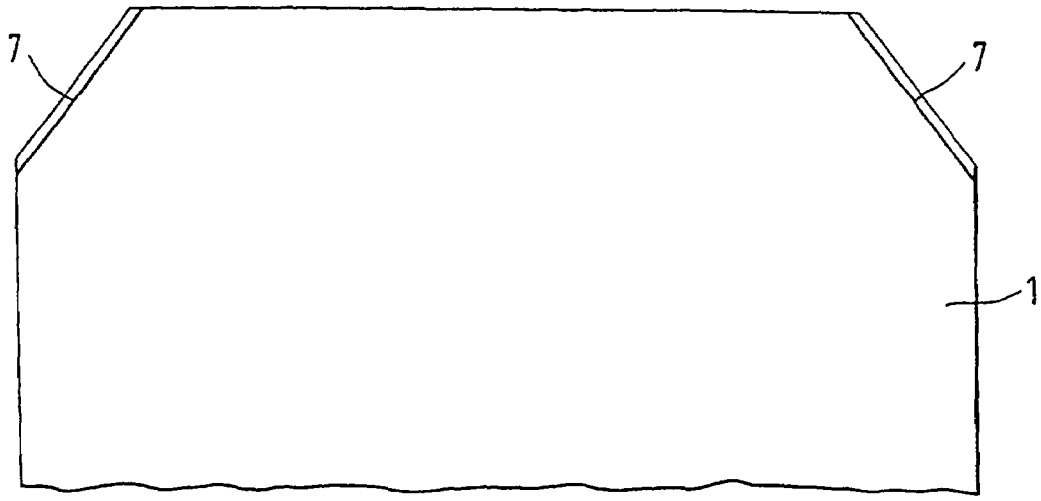

FIG. 4 shows a tube 1 that only has the angled weld seams 7 at its end, the end of the tube 1 otherwise being open.

Figure 5:
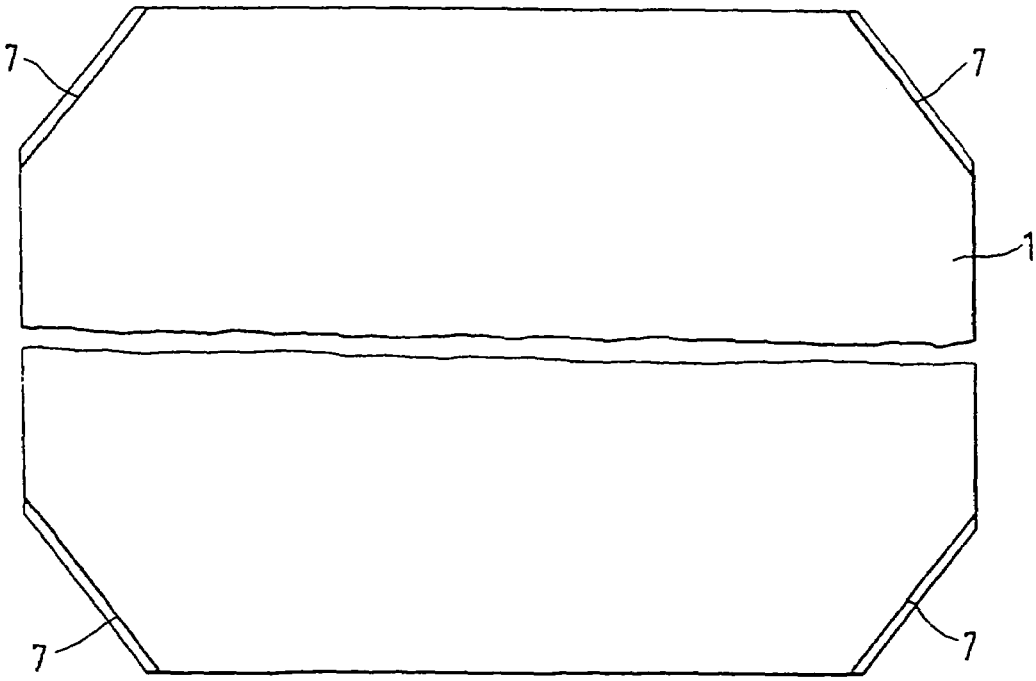

In the tube 1 of FIG. 5 the two ends have angled weld seams 7. It is clear that in order to be able to pull the tube 1 over the object stack the one end must be prestretched much more than the remainder of the tube 1. This additional stretching, which depends on the size of the object stack and on the length and orientation of the weld seams 7, can be up to 40%.

Figure 6:
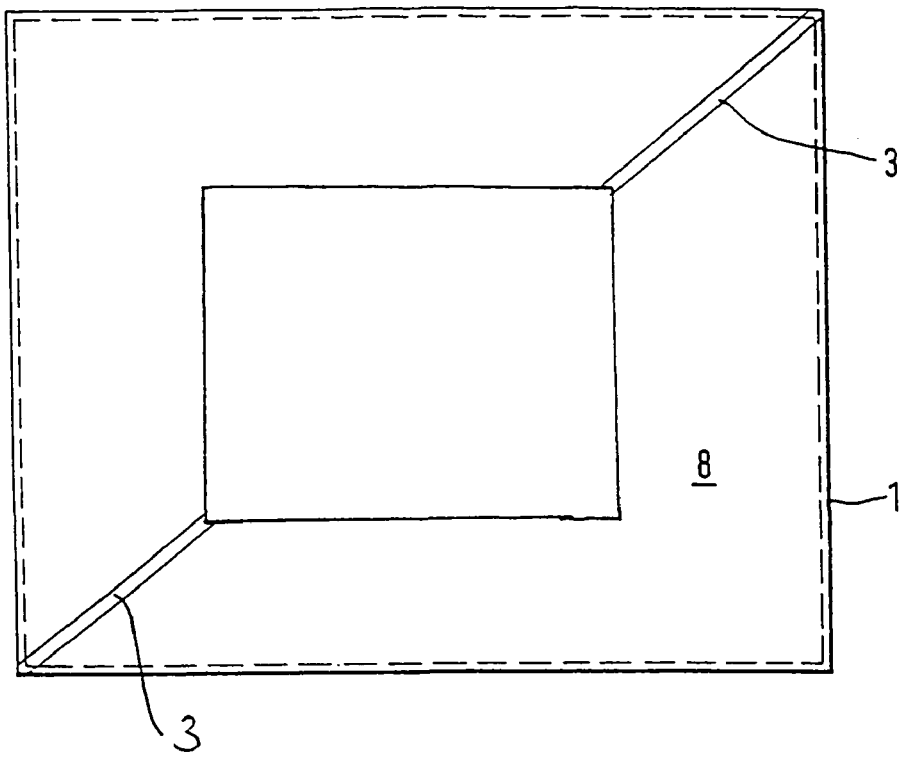
FIG. 6 is a top view of an object stack wrapped with the tube, opposite weld seams or weld-seam sections extending along a diagonal on the top of the stack.

FIG. 6 shows a top view of an object stack 8 which is wrapped by a tube 1. As clearly visible, the end weld seams 3 of the tube 1 extend along a diagonal on the top of the stack 8.

The invention claimed is:

1. A packaging method comprising the step of sequentially:

fitting a tube having a pair of opposite open ends over a plurality of stretching elements with an end portion of the tube having one of the open ends projecting past ends of the stretching elements;

transversely outwardly displacing the stretching elements to transversely stretch all of the tube except the projecting end portion;

displacing the elements and the transversely outwardly stretched tube over a stack of objects to a position with the tube extending generally a full length of the stack and the projecting end portion of the tube bearing on a respective end of the stack; and releasing the tube from the elements such that it retracts into engagement with sides of the stack and the tube end portion continues to bear on the respective end of the stack at least adjacent edges of the respective end of the stack.

2. The packaging method defined in claim 1 wherein the tube is stretched transversely by between 50% and 80%.

3. The packaging method defined in claim 1 wherein the tube is a three-layer laminate.

4. The packaging method defined in claim 3 wherein the laminate includes two copolymer outer layers sandwiching an elastomeric inner layer.

5. The packaging method defined in claim 1, wherein the end portion of the tube is formed with a pair of seams extending transversely partially across the tube and leaving the tube end open, the seams lying flatly on the respective end of the stack when the tube is released from the elements.

6. The packaging method defined in claim 5 wherein the seams extend at an angle of about 45° to the tube.

7. The packaging method defined in claim 5 wherein the stack has corners and the seams are aligned with the corners when the tube is pulled over the stack.

* * * * *